US009291355B2

(12) United States Patent
Hugghins

(10) Patent No.: US 9,291,355 B2
(45) **Date of Patent: *Mar. 22, 2016**

(54) SYSTEM AND METHOD FOR CONTROLLING A FURNACE

(71) Applicant: Trane International Inc., Piscataway, NJ (US)

(72) Inventor: Gordon Jeffrey Hugghins, Jacksonville, TX (US)

(73) Assignee: Trane International Inc., Piscataway, NJ (US)

( * ) Notice: Subject to any disclaimer, the term of this patent is extended or adjusted under 35 U.S.C. 154(b) by 306 days.

This patent is subject to a terminal disclaimer.

(21) Appl. No.: 14/167,940

(22) Filed: Jan. 29, 2014

(65) Prior Publication Data

US 2014/0147797 A1 May 29, 2014

Related U.S. Application Data

(63) Continuation of application No. 12/616,271, filed on Nov. 11, 2009, now Pat. No. 8,672,670.

(51) Int. Cl.
*F24H 3/00* (2006.01)
*F24D 19/10* (2006.01)
(Continued)

(52) U.S. Cl.
CPC ..... *F24D 19/1084* (2013.01); *F23N 1/002* (2013.01); *F23N 3/082* (2013.01); *F23N 5/184* (2013.01); *F23N 5/242* (2013.01); *F24H 3/06* (2013.01); *F23N 2005/182* (2013.01);
(Continued)

(58) Field of Classification Search
CPC ..... F24D 19/1084; F23N 1/002; F23N 5/184; F24F 3/06; F24H 3/00
USPC ..... 431/2, 12, 19, 20; 126/116 A, 110 R
See application file for complete search history.

(56) References Cited

U.S. PATENT DOCUMENTS 4,703,747 A 11/1987 Thompson et al.
4,729,207 A 3/1988 Dempsey et al.
(Continued)

OTHER PUBLICATIONS

Hugghins, Gordon Jeffrey; U.S. Appl. No. 12/616,271, filed Nov. 11, 2009; Title: System and Method for Controlling a Furnace.
(Continued)

*Primary Examiner* — Gregory Huson
*Assistant Examiner* — Nikhil Mashruwala
(74) *Attorney, Agent, or Firm* — Conley Rose, P.C.; J. Roberts Brown, Jr.; Michael J. Schofield

(57) ABSTRACT

Controlling a modulating gas furnace by monitoring a differential pressure associated with the modulating gas furnace using a low pressure limit switch configured to actuate at a first pressure, an intermediate pressure limit switch configured to actuate at a second pressure, and a high pressure limit switch configured to actuate at a third pressure, the second pressure being between the first and third pressure, selectively operating the modulating gas furnace in one of a cycling mode, a modulating mode in a lower range, and a modulating mode in an upper range, the modulating mode in the lower range being associated with an output capacity range between the output capacity ranges of the cycling mode and the modulating mode in the upper range, and selectively operating the furnace in response to at least one of the low pressure limit switch, the intermediate pressure limit switch, and the high pressure limit switch.

18 Claims, 10 Drawing Sheets

(51) Int. Cl.

| | |
|---|---|
| ***F23N 3/08*** | (2006.01) |
| ***F23N 5/18*** | (2006.01) |
| ***F23N 5/24*** | (2006.01) |
| ***F23N 1/00*** | (2006.01) |
| ***F24H 3/06*** | (2006.01) |

(52) U.S. Cl.

CPC ..... *F23N2025/04* (2013.01); *F23N 2027/02* (2013.01); *F23N 2033/08* (2013.01); *F23N 2037/10* (2013.01); *F23N 2041/02* (2013.01)

(56) References Cited

U.S. PATENT DOCUMENTS

| | | | | |
|---|---|---|---|---|
| 4,981,721 | A | 1/1991 | Krenkel et al. | |
| 4,982,721 | A | 1/1991 | Lynch | |
| 5,027,789 | A | 7/1991 | Lynch | |
| 5,331,944 | A | 7/1994 | Kujawa et al. | |
| 5,360,335 | A | 11/1994 | Anderson et al. | |
| 5,418,438 | A * | 5/1995 | Hollenbeck | F23N 1/062 165/246 |
| 5,557,182 | A | 9/1996 | Hollenbeck et al. | |
| 5,682,826 | A | 11/1997 | Hollenbeck | |
| 5,732,691 | A | 3/1998 | Maiello et al. | |
| 5,791,332 | A | 8/1998 | Thompson et al. | |
| 5,865,611 | A | 2/1999 | Maiello | |
| 5,993,195 | A | 11/1999 | Thompson | |
| 6,161,535 | A | 12/2000 | Dempsey et al. | |
| 6,257,870 | B1 | 7/2001 | Hugghins et al. | |
| 6,283,115 | B1 * | 9/2001 | Dempsey | F24H 9/0036 126/110 R |
| 6,925,999 | B2 | 8/2005 | Hugghins et al. | |
| 7,101,172 | B2 | 9/2006 | Jaeschke | |
| 7,275,533 | B2 * | 10/2007 | Soeholm | F23N 3/002 126/299 R |
| 7,296,426 | B2 | 11/2007 | Butler et al. | |
| 7,455,238 | B2 | 11/2008 | Hugghins | |
| 7,523,762 | B2 | 4/2009 | Buezis et al. | |
| 8,146,584 | B2 | 4/2012 | Thompson | |
| 8,261,733 | B2 | 9/2012 | Hugghins | |
| 9,228,758 | B2 * | 1/2016 | Hugghins | F23N 1/022 |
| 2007/0209653 | A1 * | 9/2007 | Beisheim | F23N 3/002 126/80 |
| 2008/0127962 | A1 * | 6/2008 | Thompson | F23N 5/184 126/116 A |
| 2008/0127963 | A1 | 6/2008 | Thompson | |
| 2013/0230812 | A1 * | 9/2013 | Schultz | F23N 5/00 431/12 |
| 2013/0291770 | A1 * | 11/2013 | Kashima | F23C 5/28 110/189 |

OTHER PUBLICATIONS

Office Action dated May 8, 2013; U.S. Appl. No. 12/616,271, filed Nov. 11, 2009; 15 pages.

Notice of Allowance dated Oct. 29, 2013; U.S. Appl. No. 12/616,271, filed Nov. 11, 2009; 13 pages.

Canadian Office Action; Application No. 2,720,801; Jun. 21, 2012; 4 pages.

Canadian Office Action; Application No. 2,720,801; Aug. 27, 2013; 3 pages.

* cited by examiner

SYSTEM AND METHOD FOR CONTROLLING A FURNACE

CROSS-REFERENCE TO RELATED APPLICATIONS

This application is a continuation of U.S. patent application Ser. No. 12/616,271 filed on Nov. 11, 2009 by Gordon Jeffrey Hugghins entitled "System and Method for Controlling a Furnace," which is incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and air conditioning systems (HVAC systems) sometimes incorporate gas furnaces for providing a heating effect to temperature controlled areas or comfort zones. Some gas furnaces comprise draft inducers that pull flue gases resulting from combustion through heat exchangers. It is known that draft inducers cannot dependably be factory set to a particular speed or flowrate in a manner that accommodates for the wide variation of installation furnace configurations and transient pressure fluctuations that may be present amongst different installation locations. For example, some gas furnaces may be installed with substantially different lengths of piping connected to an exhaust vent. Accordingly, it is known to provide a furnace with a variable speed draft inducer, the speed or flowrate of which may be adjusted once the gas furnace is installed and/or in operation. Some gas furnaces provide systems configured to learn operating speeds that are suitable for a particular installation of a gas furnace. For example, U.S. Pat. No. 6,257,870 (referred to hereinafter as the '870 patent) and U.S. Pat. No. 5,791,332 disclose systems and methods for operating a variable speed draft inducer of a gas furnace to account for static and dynamic variations in heat exchanger pressure differential, $H_X\Delta P$.

In some systems, operation of a gas furnace may be predicated upon feedback from a plurality of switches and/or sensors. For example, in some gas furnaces, a combustion system may be halted from operation when one or more of a temperature limit sensor, a pressure switch, and a gas valve relay are in states inconsistent with safe operation. Specifically, if a temperature limit sensor reports that a temperature is too high the combustion system may be turned off. Similarly, if a pressure switch that ensures a safe amount of exhaust flow reports that exhaust flow is not sufficient, the combustion system may be turned off. Further, if a gas valve relay is inappropriately in an open state, the combustion system may be turned off. In some gas furnaces, the above methods of ensuring safe operation of a gas furnace may be sufficient and/or required.

SUMMARY OF THE DISCLOSURE

In some embodiments of the disclosure, a modulating gas furnace is disclosed as comprising: a modulating combustion system, comprising a burner assembly, and a modulating gas valve assembly configured to modulate the amount of fuel gas delivered to the burner assembly as a result of a measured pressure differential; wherein the modulating combustion system is configured to selectively maintain steady state operation at a plurality of firing rates within at least one of a cycling mode, a modulating mode in a lower range, and a modulating mode in an upper range.

In other embodiments of the disclosure, a modulating gas furnace is disclosed as comprising: a low pressure limit switch configured to actuate at a first pressure; an intermediate pressure limit switch configured to actuate at a second pressure; and a high pressure limit switch configured to actuate at a third pressure, wherein the second pressure is between the first pressure and the third pressure; wherein the modulating gas furnace is configured to operate in one of a cycling mode, a modulating mode in a lower range, and a modulating mode in an upper range in response to at least one of the low pressure limit switch, the intermediate pressure limit switch, and the high pressure limit switch; wherein the modulating mode in the lower range is associated with an output capacity range between the output capacity ranges of the cycling mode and the modulating mode in the upper range; and wherein the modulating gas furnace is configured to selectively maintain steady state operation at a plurality of firing rates within at least one of the modulating mode in the lower range and the modulating mode in the upper range.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION

Some gas furnaces are configured as variable output capacity devices (also referred to as "modulating furnaces"). Due to the inherent difference in some modulating gas furnaces from other types of gas furnaces, i.e. mechanically ensuring that the provision of fuel gas is in proportion to exhaust and/or oxygen flow, current safety methods may unnecessarily contribute to interruptions in operation of a modulating gas furnace and with no added safety benefit. More specifically, and as further described below, because a modulating gas valve may be pneumatically or otherwise linked to provide fuel gas in response to an actual pressure differential, there is no risk that extraneous fuel gas will be emitted out of proportion to the actual oxygen and exhaust flow provided. Accordingly, the present disclosure provides systems and methods for safely controlling a modulating gas furnace with reduced interruptions in operation while also providing systems and methods for ensuring operation of the modulating gas furnace at the output capacity demanded.

The systems and methods of the present disclosure provide such safe operation of a gas furnace by selectively monitoring a plurality of pressure switches and/or sensors and responding to actuations of the switches and/or sensors based on both the length of time switches and/or sensors remain actuated and based on the current demand for output capacity. The systems and methods provided allow the modulating gas furnaces to operate so that the modulating combustion systems of the furnaces are not interrupted in response to spurious pressure differential changes that pose no safety risk. The systems and methods provided also allow the modulating gas furnaces to operate so that the modulating combustion systems may be selectively recalibrated, i.e., operating curves may be relearned, in response to persistent and/or significant fluctuations in pressure the differential.

Figure 1:
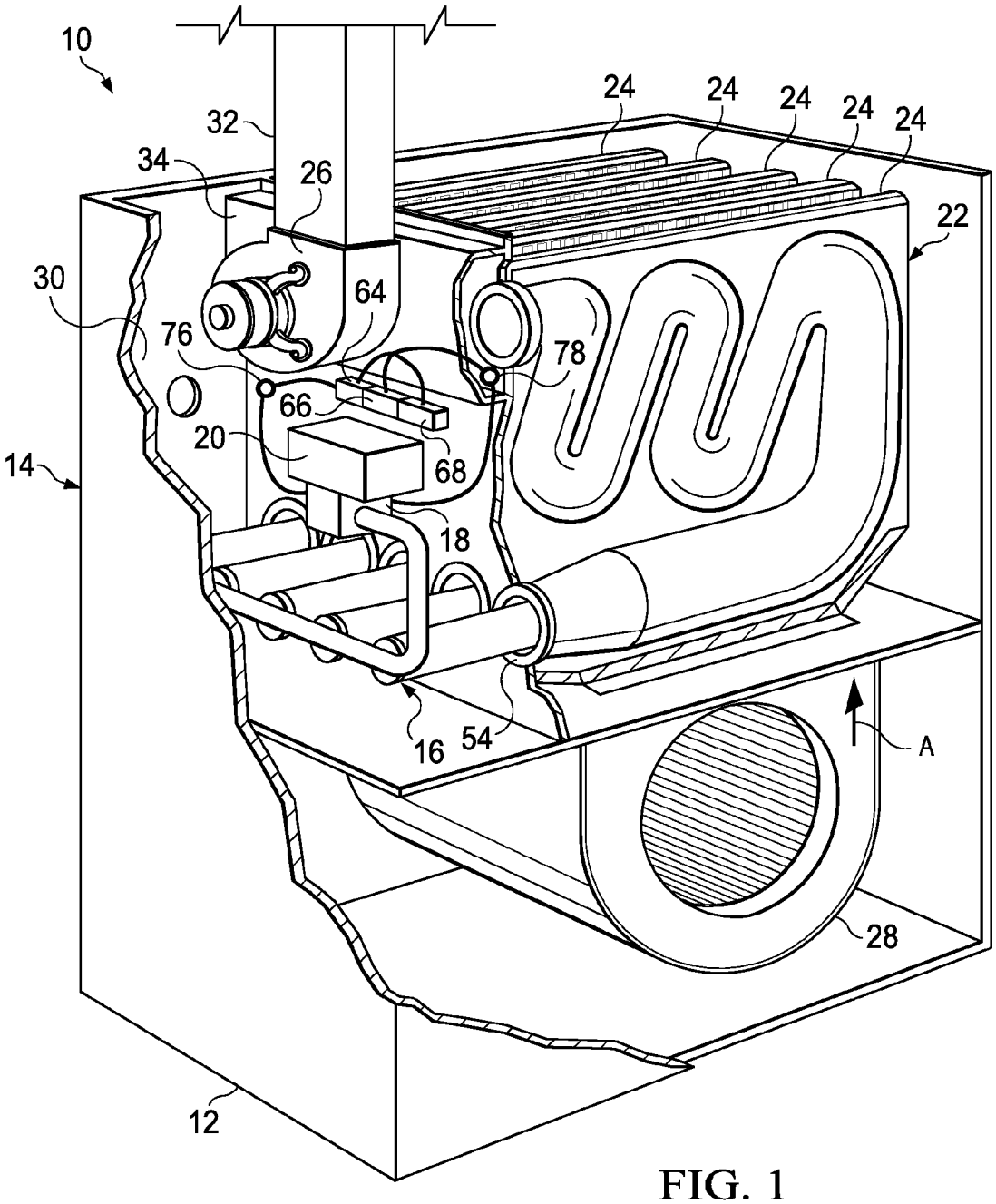
FIG. 1 is a cut-away view of a modulating gas furnace according to embodiments of the disclosure.

FIG. 1 shows a modulating gas furnace 10 that comprises substantial similarities to the gas furnace of U.S. Pat. No. 6,257,870 issued to Gordon Jeffrey Hugghins et al. and which is hereby incorporated by reference in its entirety. However, the modulating gas furnace 10 differs from the furnace of the '870 patent at least because the furnace 10 comprises a modulating combustion system 14. It will be appreciated that the term, "modulating," as used in this disclosure is meant to indicate that a system or device may be selectively operated at substantially any value over a range of performance values in a manner consistent with a control resolution of the system. Generally, the furnace 10 is operable so that the furnace 10 may selectively perform at substantially any selected output capacity value (kBtu/Hr) ranging from a maximum output capacity (100% output capacity) to a minimum output capacity (e.g., in some embodiments, about 40% of the maximum output capacity) with the modulating combustion system 14 capable of being constantly operated over a range of output capacities.

The modulating combustion system 14 is housed within the cabinet 12 and comprises a burner assembly 16, a modulating gas valve assembly 18, and a control assembly 20. The furnace 10 further comprises a heat exchanger assembly 22 which comprises a plurality of heat exchangers 24, a variable speed induced draft blower 26, and a variable speed circulating air blower 28. It will be appreciated that the furnace 10 further comprises a combustion intake space 30 that surrounds the exterior of the draft blower 26 and the exterior of the heat exchangers 24. When the draft blower 26 draft is operated, air is drawn from the intake space 30 and is passed through the heat exchangers 24 and into a header 34 that accepts exhaust from the heat exchangers 24 and provides a flow path for the exhaust to reach the draft blower 26. It will be appreciated that during operation of the furnace 10, the local pressure within the intake space 30 may be different from the local pressure within the header 34.

The pressure difference that exists between the intake space 30 and the header 34 is referred to as the combustion system pressure differential, or alternatively, may simply be referred to as the heat exchanger pressure differential ($H_X\Delta P$) or simply pressure differential. It is further understood by those of ordinary skill in the art of gas furnaces that the pressure differential may depend or vary in response to the physical nature of an exhaust vent 32 connected downstream of the draft blower 26, atmospheric conditions that affect the pressure within the intake space 30 and the header 34, and the speed of operation of the draft blower 26, among other factors. For example, the exhaust vent 32 and any other structure joined downstream of the exhaust vent 32 may experience a buildup of condensation within the interior of the exhaust vent 32 and attached devices. Such a buildup of condensation may increase resistance to fluid flow through the exhaust vent 32 which may increase the above-described pressure differential. Similarly, if the exhaust vent 32 is vented to an exterior of a building that is exposed to variations in wind speed or external barometric pressure, a change in wind speed or external barometric pressure may also cause variation in the pressure differential. Of course, changes in pressure local to the intake space 30 also may cause variation in the pressure differential.

Figure 2:
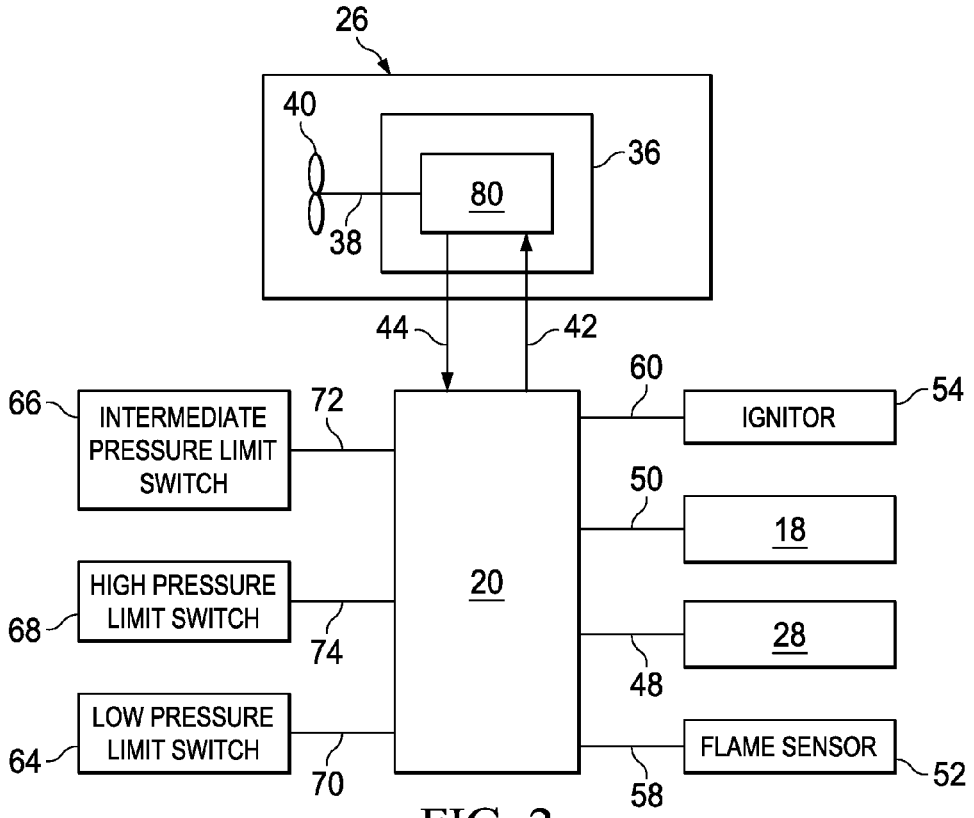
FIG. 2 is a simplified block diagram of some control components of the modulating gas furnace of FIG. 1 according to embodiments of the disclosure.

FIG. 2 shows an embodiment of the control assembly 20 as connected to various system components, including the draft blower 26. In the embodiment of FIG. 2, the draft blower 26 comprises a motor 36 for driving a shaft 38 which drives a blower wheel or fan 40. The motor 36 is a variable speed motor capable of sensing an operating speed and an operating torque of the motor 36 and communicating the operating speed and operating torque values to the control assembly 20. In this embodiment, the control assembly 20 is connected to the motor 36 by a communications transmit line 42 and a communications receive line 44. Of course, in other embodiments, the above-described bidirectional communication capability between the control assembly 20 and the motor 36 may be accomplished in any other suitable manner. Further, in some embodiments, communication between the control assembly 20 and the motor 36 may comprise use of digital serial communication methods. The control assembly 20 is connected to the modulating gas valve assembly 18 by control line 50. A flame sensor 52 and an igniter 54 are connected to the control assembly 20 by electrical lines 58 and 60, respectively.

Referring now to both FIGS. 1 and 2, the furnace 10 further comprises three pressure switches, a low pressure limit switch 64, an intermediate pressure limit switch 66, and a high pressure limit switch 68. Each of the pressure switches 64, 66, and 68 may be implemented as switches which open below desired pressure limits and close above the desired pressure limits. However, in alternative embodiments, the pressure switches 64, 66, and 68 may be replaced by pressure sensors suitable for sending analog or digital signals to control assembly 20. In this embodiment, the pressure switches 64, 66, and 68 are connected to the control assembly by pressure signal lines 70, 72, and 74, respectively. Each of the switches 64, 66, and 68 measure the pressure differential through the use of an upstream pressure tap 76 configured to monitor the pressure of the combustion intake space 30 and a downstream pressure tap 78 configured to monitor the pressure within the header 34. In alternative embodiments, the pressure taps 76 and 78 may be placed to monitor pressure of other locations that similarly provide pressure feedback necessary to operate switches 64, 66, and 68 in response to the pressure differential. It will further be appreciated that upstream pressure tap 76 and downstream pressure tap 78 are also pneumatically connected to modulating gas valve assembly 18 so that variations in the pressure differential result in substantially proportional variations in fuel gas provided to the burner assembly 16 by the modulating gas valve assembly 18.

Accordingly, the furnace 10 may be controlled to provide a desired output capacity by first controlling the speed of the induced draft blower 26, which affects the pressure differential and may cause the modulating gas valve assembly 18 to modulate to provide an appropriate fuel gas flow in response to the sensed pressure differential. Generally, this operation is possible due to the predicable and substantially proportional relationships between changes in draft blower 26 speed or RPM and the resultant changes in pressure differential and oxygen provided to the burner assembly 16 for combustion. In operation, changes in the induced draft blower 26 speed cause proportional and appropriate changes in the fuel gas provided by the modulating gas valve assembly 18.

The draft inducer motor 36 further comprises an integral controller 80 configured to communicate with the control assembly 20 regarding the status of the switches 64, 66, and 68. In alternative embodiments, the status of the switches 64, 66, and 68 may be input directly to the integral controller 80 via pressure signal lines 70, 72, and 74, respectively. In this disclosure, references to the draft blower motor 36 also refer to the component parts of the motor 36, including the integral controller 80. The motor 36 and/or the control assembly 20 may comprise control algorithms suitable for determining suitable operating speeds for the draft blower 26.

Figure 3:
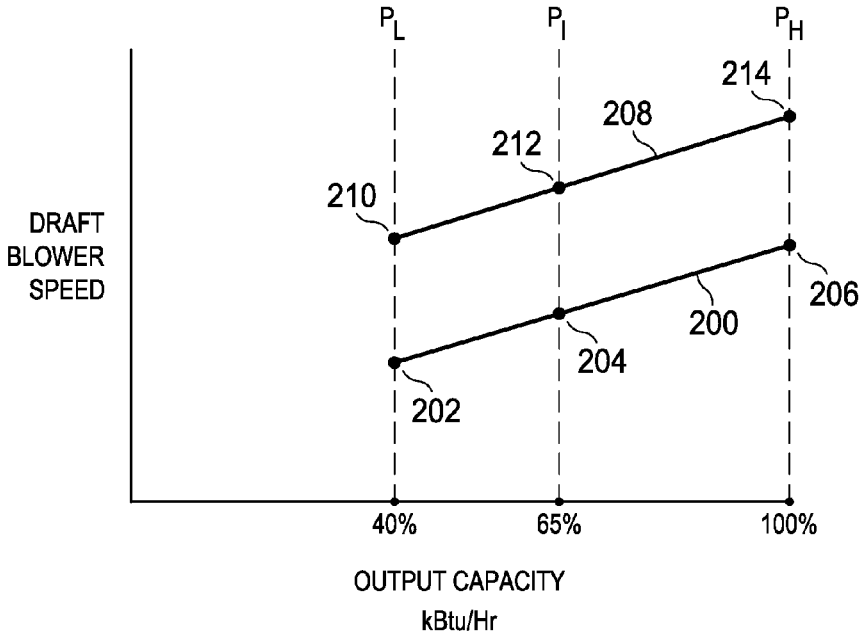
FIG. 3 is chart that illustrates two operating curves for the gas furnace of FIG. 1.

Referring now to FIG. 3, two actual operating curves of the modulating gas furnace 10 are shown. A lower actual operating curve 200 is shown as a substantially linear curve extending from about 40% output capacity to 100% output capacity. The lower actual operating curve 200 is representative of the draft blower 26 speed needed to cause the modulating gas valve assembly 18 and other components of the furnace 10 to operate at specified output capacities. In this embodiment, a low operating point 202 is associated with the draft blower 26 speed required to provide a low output capacity. In some embodiments, the low output capacity may have a value of 40% output capacity. Intermediate operating point 204 is associated with the draft blower 26 speed required to provide an intermediate output capacity. In some embodiments, the intermediate output capacity may have a value of 65% output capacity. High operating point 206 is associated with the draft blower 26 speed required to provide a high output capacity. In some embodiments, the high output capacity may have a value of 100% operating capacity.

The actual operating curve 200 is appropriate for use in controlling the furnace 10 under a first set of pressure conditions that yield a first pressure differential. However, if the pressure conditions change to a second set of pressure conditions yielding a pressure differential value higher than the first pressure differential, the actual operating curve 208 may become the appropriate curve to use in controlling the furnace 10. It will be appreciated that under the second set of pressure conditions, the draft blower 26 speed associated with low, intermediate, and high operating points 210, 212, 214, although higher in speed values than points 202, 204, 206, respectively, are required to provide the same low, intermediate, and high output capacities.

Further, it can be seen that while the differential pressures $P_L$, $P_I$, and $P_H$ required to operate the furnace 10 at low, intermediate, and high output capacities, respectively, remain constant regardless of changes in pressure conditions. Such constant relationships between differential pressure and output capacity allows low pressure limit switch 64 (when configured to actuate at $P_L$), intermediate pressure limit switch 66 (when configured to actuate at $P_I$), and high pressure limit switch 68 (when configured to actuate at $P_H$) to provide information to motor 36 and/or control assembly 20. Such information may be used by the draft blower 26 and/or control assembly 20 to capture and/or store appropriate draft blower 26 speed values at which the draft blower 26 must be operated to result in the furnace 10 operating at the respective output capacities. It will be appreciated that the furnace 10 is configured to establish operating curves in order for the furnace 10 to reliably be operated at a selected output capacity. In some embodiments, such determination may be accomplished by learning values for variables, LOW, INTERMEDIATE, and/or HIGH (each described in greater detail below) and thereafter establishing one or more operating curves based on the learned variables. It will be appreciated that the variables, LOW, INTERMEDIATE, and HIGH, may be used to store various draft blower 26 speeds (RPM) that generate the differential pressures, $P_L$, $P_I$, and $P_H$, respectively.

Still referring to FIG. 3, it will be appreciated that in some embodiments, operation of the furnace 10 may be described as occurring in various modes. More specifically, in some embodiments, if a DEMAND value (in some embodiments, expressed in terms of output capacity percentage) that represents the current system requirement and/or request for heat is below the output capacity associated with the low pressure limit switch 64, the furnace 10 may be cycled on and off at the low output capacity associated with the low pressure limit switch 64. Such cyclical operation of the furnace 10 at the output capacity associated with the low pressure limit switch 64 in response to a DEMAND lower than the output capacity associated with the low pressure limit switch 64 may be referred to as operation in a "cycling mode". Operation of the furnace 10 at or above the low output capacity causes the furnace to operate in a "modulating mode" where the furnace 10 is continually operated until the DEMAND falls below the low output capacity. While operating in the modulating mode, the furnace 10 may be described as operating within one of three categories of modulating operation.

Specifically, the furnace 10 may operate in the modulating mode to provide an output capacity (1) equal to or greater than the low output capacity and less than the intermediate output capacity in a so-called "lower range" of the modulating mode, (2) equal to or greater than the intermediate output capacity and less than the high output capacity in a so-called "upper range" of the modulating mode, or (3) at the high output capacity in a so-called "maximum output" of the modulating mode. As such, the furnace 10 may operate in any one of the cycling mode, the modulating mode in the lower range, the modulating mode in the upper range, and the modulating mode at a maximum output. As explained above, in some embodiments, the low output capacity, intermediate output capacity, and high output capacity may have values of 40%, 65%, and 100% output capacity, respectively.

Accordingly, operating the furnace 10 in response to a DEMAND greater than or equal to the output capacity associated with the low pressure limit switch 64 (low output capacity) but not greater than the output capacity associated with the intermediate pressure limit switch 66 (intermediate output capacity) results in operating the furnace 10 in the modulating mode in the lower range. Similarly, operating the furnace 10 in response to a DEMAND greater than the output capacity associated with the intermediate pressure limit switch 66 (intermediate output capacity) but less than the output capacity associated with the high pressure limit switch 68 (high output capacity) results in operating the furnace 10 in the modulating mode in the upper range. Finally, operating the furnace 10 in response to a DEMAND equal to the output capacity associated with the high pressure limit switch 68 also results in operating the furnace 10 in the modulating mode at maximum output. In this embodiment, the DEMAND value may be generated and communicated to the control assembly 20 by a thermostat and/or other devices.

It will further be appreciated that each of the above-described modes and ranges of operation may have an associated and/or predefined maximum draft motor 26 speed above which the draft motor 26 should not operate. Similarly, each of the above-described modes and ranges of operation may have an associated and/or predefined minimum draft motor 26 speed below which the draft motor 26 should not operate. It will be appreciated that in order for a pressure switch, for example, intermediate pressure limit switch 66, to be actuated, the pressure differential must equal or exceed the actuation set point of the switch 66. Accordingly, to ensure that intermediate pressure limit switch 66 is consistently in an actuated state (in this embodiment, in a closed state) the draft motor 26 may be operated at a slightly higher speed than required to close the switch 66. Such operation of the draft blower 26 at speeds higher than the speeds required to actuate switches 64, 66, 68 prevents very small fluctuations in pressure differential from changing the state of switches 64, 66, 68 and further allows for a degree of acceptable draft motor 26 speed variation without undesirably indicating that the furnace 10 is not operating within the appropriate mode of operation.

Given the above, the furnace 10 may be configured to operate in response to various DEMAND values by selectively operating in the cycling mode for various durations or in the modulating mode at various output capacities. Further, it will be appreciated that operation of the furnace 10 in the modulating mode in the lower range may occur during a learning routine in which the furnace 10 attempts to establish one of an estimated learning curve and an actual learning curve for modulating mode operation in the lower range. Similarly, operation of the furnace 10 in the modulating mode in the upper range may occur during a learning routine in which the furnace 10 attempts to establish one of an estimated learning curve and an actual learning curve for modulating mode operation in the upper range. Further, as will be explained below, in response to feedback from the switches 64, 66, 68, the furnace 10 may issue a RELEARN command that requires one or more of LOW, INTERMEDIATE, HIGH, and one or more estimated or actual operating curves to be relearned by operating the furnace 10 according to one or more learning routines.

It will be appreciated that the control assembly 20 and/or other components of the gas furnace 10 may comprise algorithms for using feedback from switches 64, 66, 68 to safely operating the gas furnace 10. More specifically, the gas furnace 10 may comprise algorithms to monitor the states of the low, intermediate, and high pressure limit switches 64, 66, 68 to selectively disable the modulating combustion system 14 by (closing the gas valve 18) and the draft blower 26. Further, even though the furnace 10 may be operated safely due to the direct relationship between the actual pressure differential and the fuel gas provided, the selective issuance of RELEARN commands in response to feedback from switches 64, 66, 68 assists in ensuring the furnace 10 is operating to meet the needs of the DEMAND value.

The discussion below explains the operation of furnace 10 as it relates to various modes and ranges of operation, namely, an ignition sequence that precedes each startup of the modulating combustion system 14, operation in cycling mode, operation in modulating mode in the lower range, operation in modulating mode in the upper range, operation in modulating mode in the lower range while learning an operating curve for modulating mode in the lower range, and operation in the modulating mode in the upper range while learning an operating curve for modulating mode in the upper range.

Figure 4:
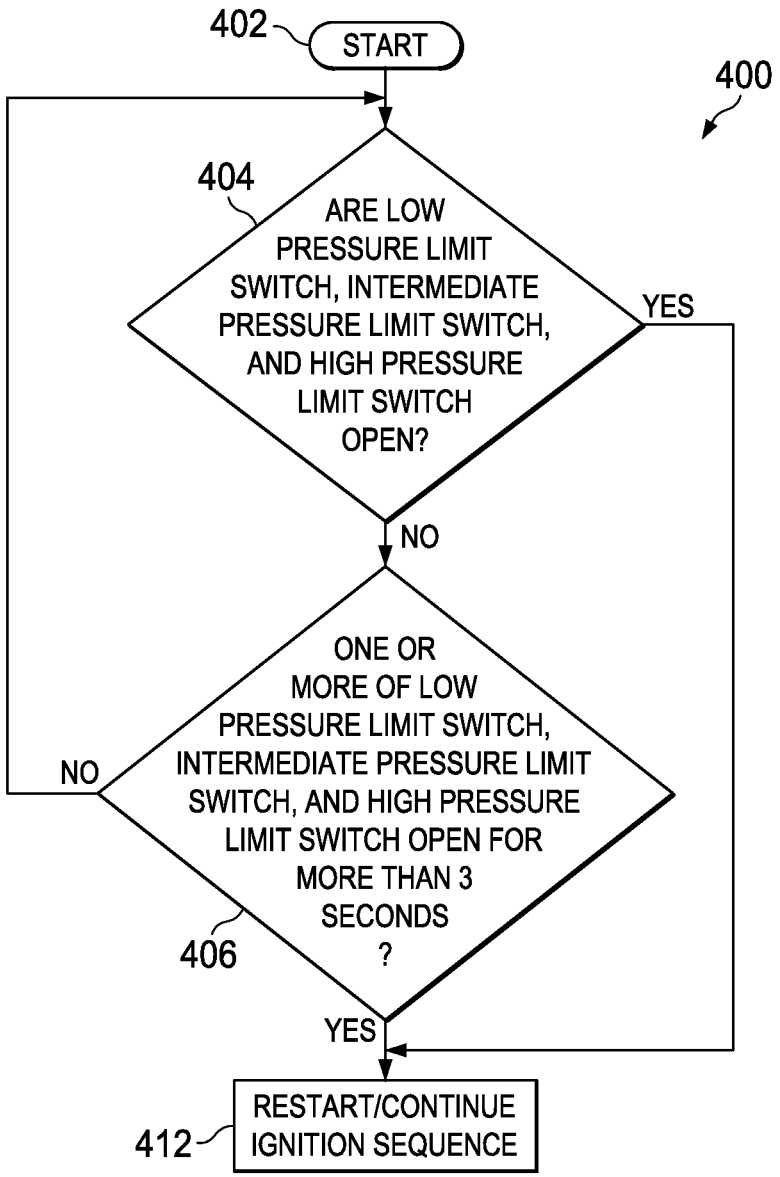
FIG. 4 comprises a flow chart that illustrates a method of operating the modulating gas furnace of FIG. 1 during an ignition sequence.

Referring now to FIG. 4, a method 400 of controlling the furnace 10 in response to feedback from switches 64, 66, 68 during operation of the furnace 10 in an ignition sequence is shown. The method 400 may start at block 402, for example, in response to the furnace 10 first being called to operate in an ignition sequence prior to operating the modulating combustion system 14 to combust fuel gas.

Proceeding to block 404, the furnace 10 determines whether all of the low pressure limit switch 64, the intermediate pressure limit switch 66, and the high pressure limit switch 68 are open. If all the pressure switches 64, 66, 68 are not open, the method proceeds to block 406. If all the pressure switches 64, 66, 68 are open, the method proceeds to block 412.

At block 406, the method determines whether one or more of the low pressure limit switch 64, the intermediate pressure limit switch 66, and the high pressure limit switch 68 remain open for more than 3 seconds. If none of the switches 64, 66, 68 remain open for more than 3 seconds, the method proceeds back to block 404. If one or more of the switches 64, 66, 68 does remain open for more than 3 seconds, the method proceeds to block 412.

At block 412, the ignition sequence is continued and/or restarted. More specifically, if the method has proceeded to block 412 directly from block 404, the ignition sequence is continued. However, if the method has proceeded to block 412 from block 406, the ignition sequence is restarted.

Figure 5:
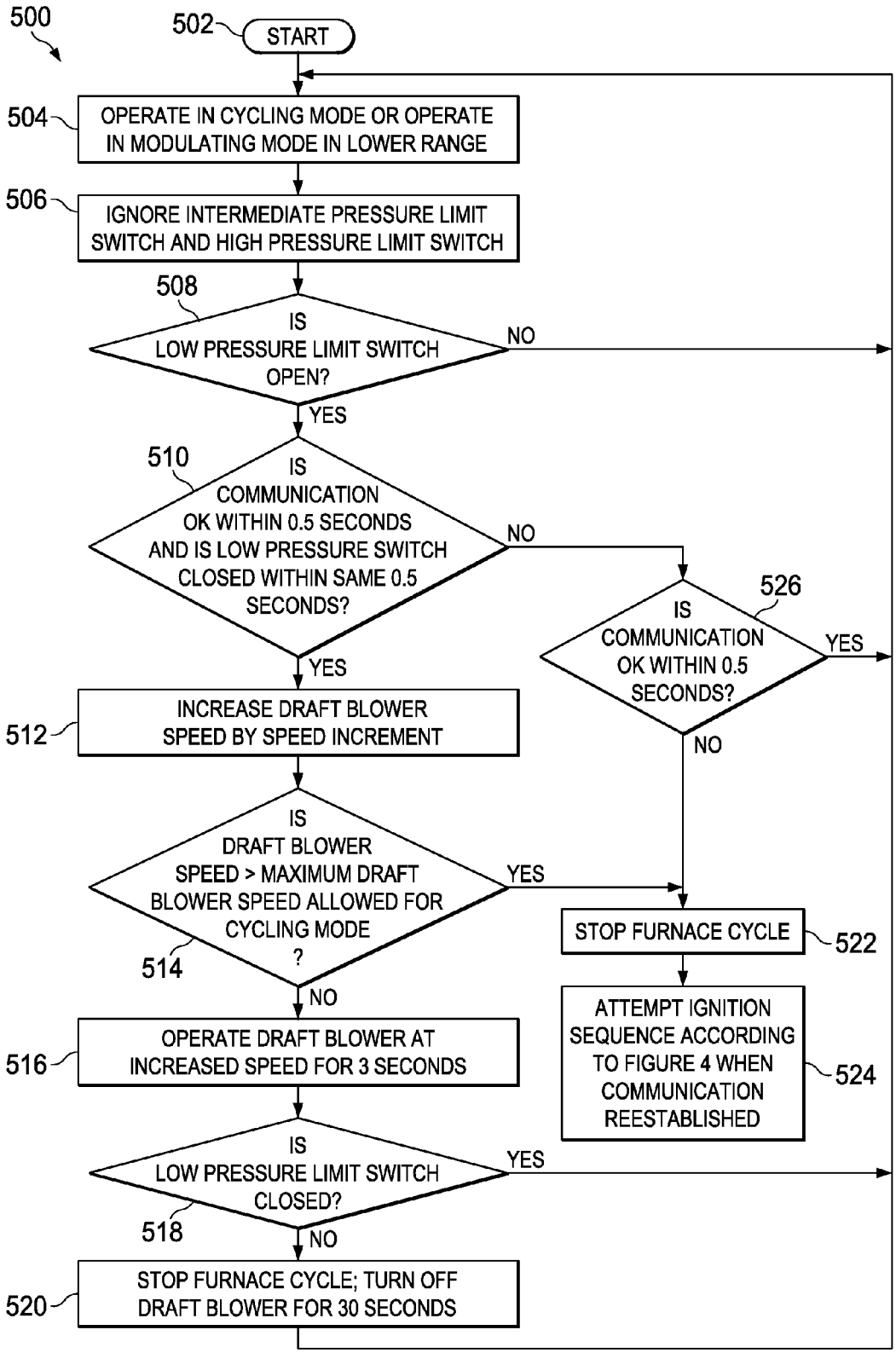
FIG. 5 comprises a flow chart that illustrates a method of operating the modulating gas furnace of FIG. 1 during operation in a cycling mode.

Referring now to FIG. 5, a method 500 of controlling the furnace 10 in response to feedback from switches 64, 66, 68 during operation of the furnace 10 in cycling mode or modulating mode in the lower range is shown. The method 500 may start at block 502, for example, in response to the furnace 10 being caused to operate in cycling mode or in modulating mode in the lower range.

Proceeding to block 504, the furnace 10 operates either in cycling mode or in modulating mode in the lower range and proceeds to block 506.

At block 506, since the furnace 10 is being operated either in cycling mode or in modulating mode in the lower range, the states of the intermediate pressure limit switch 66 and the high pressure limit switch 68 are ignored. The method then proceeds to block 508.

At block 508, the method determines whether the low pressure limit switch 64 is open. If the low pressure limit switch 64 is not open, the method proceeds back to block 504. If the low pressure limit switch 64 is open, the method proceeds to block 510.

At block 510, the method determines whether communication necessary to monitor the state of low pressure limit switch 64 is verified as operating correctly within 0.5 seconds and further whether the low pressure limit switch is closed within 0.5 seconds. If the method determines the answer to the question of block 510 to be no, the method proceeds to block 526. If the method determines the answer to the question of block 510 to be yes, the method proceeds to block 512.

At block 512, the speed of the draft blower 26 is set to be increased by a predetermined speed increment. The method then proceeds to block 514.

At block 514 the method determines whether the increased draft blower 26 speed set at block 512 is greater than the maximum allowable draft blower 26 speed for the cycling mode. If the method determines the answer to the question of block 514 to be yes, the method proceeds to block 522. If the method determines the answer to the question of block 514 to be no, the method proceeds to block 516.

At block 516, the draft blower 26 is operated at the increased speed for 3 seconds. The method then proceeds to block 518.

At block 518, the method determines whether the low pressure limit switch 64 is closed. If the switch 64 is closed, the method proceeds back to block 504. If the switch 64 is open, the method proceeds to block 520.

At block 520, the furnace cycle is stopped and the draft blower 26 is turned off for 30 seconds. The method then proceeds to block 504. Accordingly, the method continues to increase the draft blower 26 speed by the predetermined speed increment until the low pressure limit switch 64 is closed or until the set draft blower 26 speed exceeds the maximum draft blower 26 speed for the cycling mode.

If the method proceeds to block 526 from block 510, at block 526 the method will determine whether the necessary communication to monitor the state of the low pressure limit switch 64 is verified as operating correctly. If such communication is verified as operating correctly, the method proceeds back to block 504. If such communication is not verified as operating correctly, the method proceeds from block 526 to block 522.

At block 522, the method stops the furnace cycle by discontinuing operation of the modulating combustion system 14 and the draft blower 26. The method then proceeds to block 524.

At block 524, the method may attempt to initiate an ignition sequence. In some embodiments, operating the furnace 10 according to an ignition sequence may comprise operating the furnace 10 in accordance with the method 400 of FIG. 4.

Figure 6:
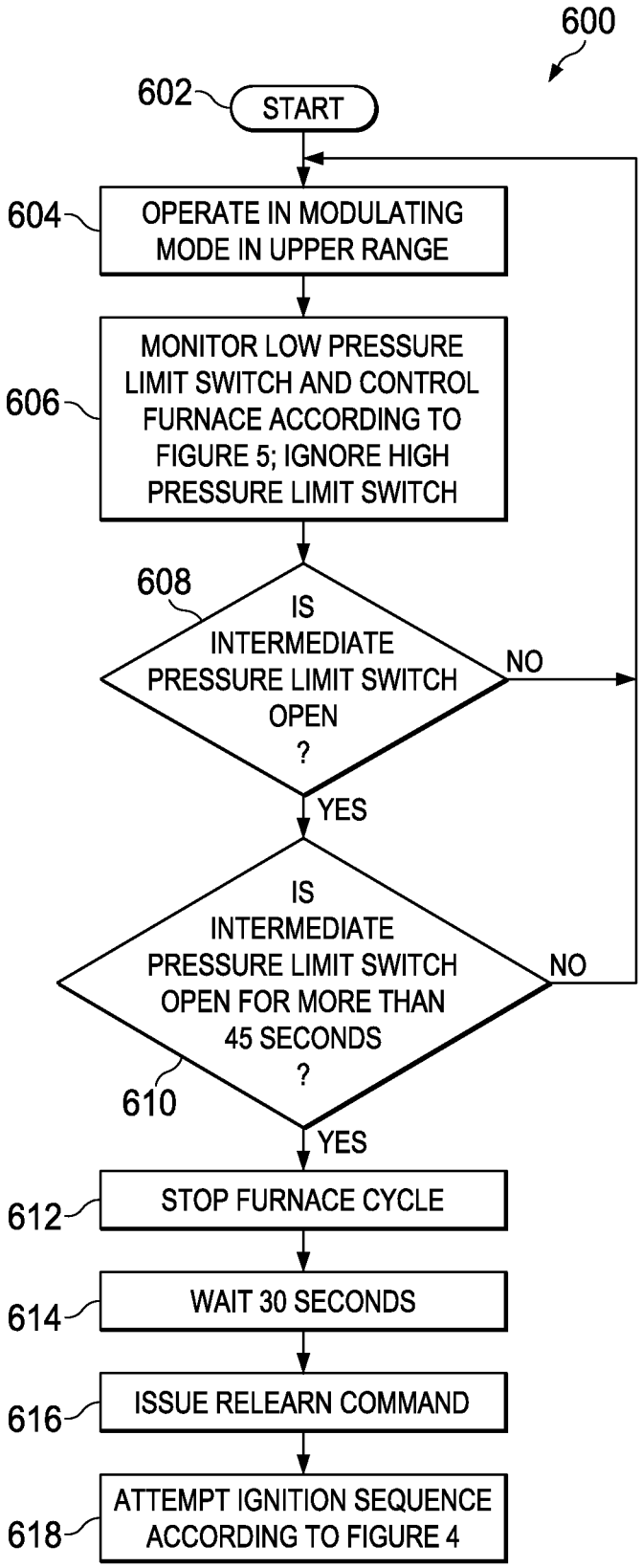
FIG. 6 comprises a flow chart that illustrates a method of operating the modulating gas furnace of FIG. 1 during operation in a modulating mode in an upper range.

Referring now to FIG. 6, a method 600 of controlling the furnace 10 in response to feedback from switches 64, 66, 68 during operation of the furnace 10 in modulating mode in the upper range is shown. The method 600 may start at block 602, for example, in response to the furnace 10 being caused to operate in modulating mode in the upper range.

Proceeding to block 604, the furnace 10 operates in modulating mode in the upper range and proceeds to block 606.

At block 606, the furnace 10 monitors the low pressure limit switch 64 and controls the furnace 10 according to blocks 508-526 of the method 500 of FIG. 5 but ignores the state of the high pressure limit switch 68. The method then proceeds to block 608.

At block 608, the method determines whether the intermediate pressure limit switch 66 is open. If the switch 66 is not open, the method proceeds back to block 604. If the switch 66 is open, the method proceeds to block 610.

At block 610, the method determines whether the intermediate pressure limit switch 66 remains open for more than 45 seconds. If the switch 66 does not remain open for more than 45 seconds, the method proceeds back to block 604. If the switch 66 does remain open for more than 45 seconds, the method proceeds to block 612.

At block 612, the furnace cycle is stopped by discontinuing operation of the modulating combustion systems 14 and stopping the draft blower 26. The method then proceeds to block 614.

At block 614 the method waits 30 seconds. The method then proceeds to block 616.

At block 616, the furnace 10 issues a RELEARN command. The method then proceeds to block 618.

At block 618, the method may attempt to initiate an ignition sequence. In some embodiments, operating the furnace 10 according to an ignition sequence may comprise operating the furnace 10 in accordance with the method 400 of FIG. 4.

It will be appreciated that while the monitoring of the low pressure limit switch in controlling the furnace 10 according to blocks 508-526 of the method 500 of FIG. 5 is shown as being in series with the steps of the method 600, in some embodiments, such monitoring and control of the furnace 10 in response to the low pressure limit switch 64 may be implemented in parallel to the blocks 608-618 of method 600. Further, in such embodiments where parallel and/or simultaneous monitoring of the low pressure limit switch 64 occurs during operation in modulating mode in the upper range, any call for shutting down or discontinuing functionality of the furnace 10 in response to the status of the low pressure limit switch 64 shall be effectuated regardless of whether block 608-618 of method 600 call for a similar shutting down of the furnace 10.

Figure 7:
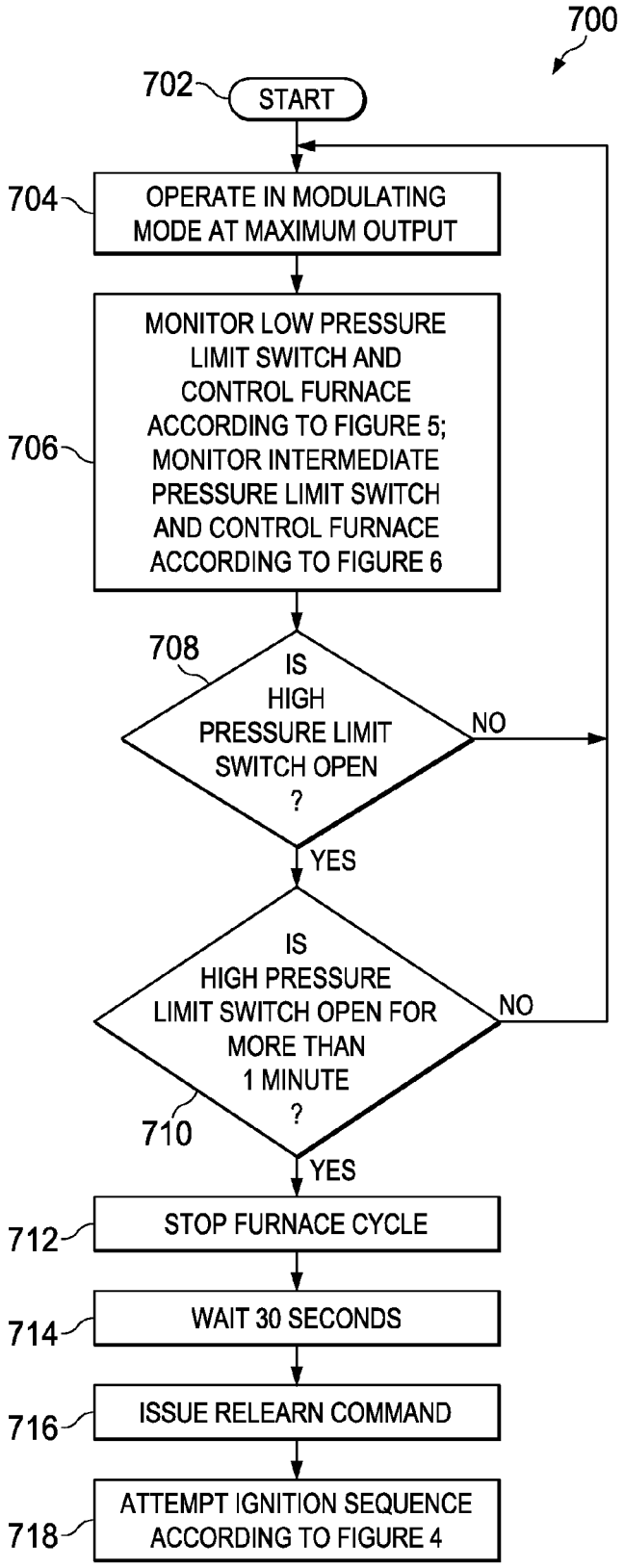
FIG. 7 comprises a flow chart that illustrates a method of operating the modulating gas furnace of FIG. 1 during operation in a modulating mode at a maximum output.

Referring now to FIG. 7, a method 700 of controlling the furnace 10 in response to feedback from switches 64, 66, 68 during operation of the furnace 10 in modulating mode at an output capacity equal to high output capacity is shown. The method 700 may start at block 702, for example, in response to the furnace 10 being caused to operate in modulating mode at an output capacity equal to high output capacity.

Proceeding to block 704, the furnace 10 operates in modulating mode at maximum output and proceeds to block 706.

At block 706, the furnace 10 monitors the low pressure limit switch 64 and controls the furnace 10 according to the blocks 508-526 of method 500 of FIG. 5 and also monitors the intermediate pressure limit switch 66 and controls the furnace 10 according to blocks 608-618 of the method 600 of FIG. 6. The method then proceeds to block 708.

At block 708, the method determines whether the high pressure limit switch 68 is open. If the switch 68 is not open, the method proceeds back to block 704. If the switch 68 is open, the method proceeds to block 710.

At block 710, the method determines whether the high pressure limit switch 68 remains open for more than one minute. If the switch 68 does not remain open for more than one minute, the method proceeds back to block 704. If the switch 68 does remain open for more than one minute, the method proceeds to block 712.

At block 712, the furnace cycle is stopped by discontinuing operation of the modulating combustion systems 14 and stopping the draft blower 26. The method then proceeds to block 714.

At block 714 the method waits 30 seconds. The method then proceeds to block 716.

At block 716, the furnace 10 issues a RELEARN command. The method then proceeds to block 718.

At block 718, the method may attempt to initiate an ignition sequence. In some embodiments, operating the furnace 10 according to an ignition sequence may comprise operating the furnace 10 in accordance with the method 400 of FIG. 4.

The monitoring of the low pressure limit switch 64 according to the blocks 508-526 of method 500 of FIG. 5 and also monitoring the intermediate pressure limit switch 66 according to blocks 608-618 of the method 600 of FIG. 6 is shown as being in series with the steps of the method 700. However, in some embodiments, such monitoring and control of the furnace 10 in response to both the low pressure limit switch 64 and the intermediate pressure limit switch 66 may be implemented in parallel to the blocks 708-718 of the method 700. Further, in such embodiments where parallel and/or simultaneous monitoring of the low pressure limit switch 64 and the intermediate pressure limit switch 66 occurs during operation in modulating mode at maximum capacity, any call for shutting down or discontinuing functionality of the furnace 10 in response to the status of the low pressure limit switch 64 and/or the intermediate pressure limit switch 66 shall be effectuated regardless of whether block 708-718 of method 700 call for a similar shutting down of the furnace 10.

Figure 8:
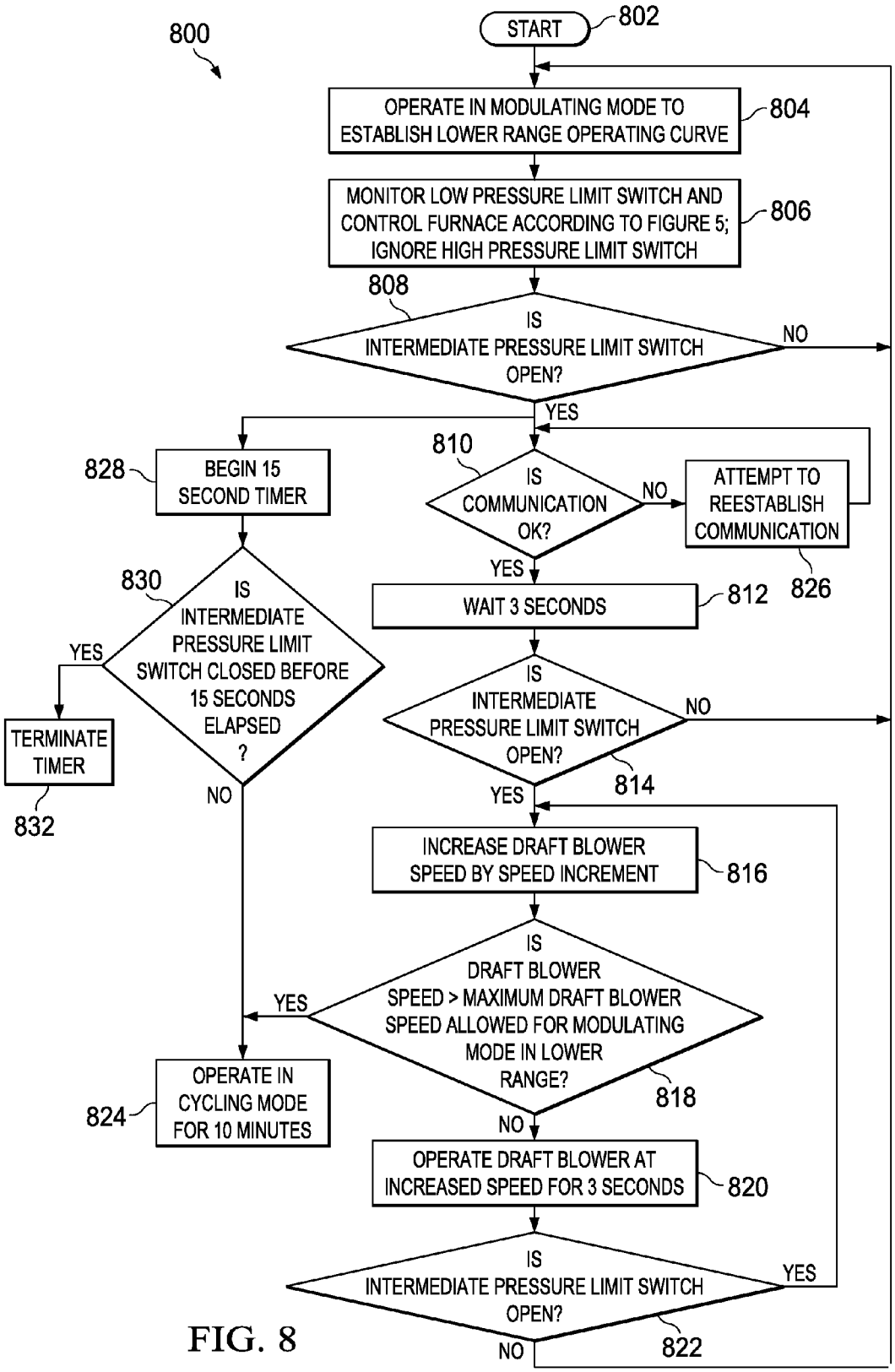
FIG. 8 comprises a flow chart that illustrates a method of operating the modulating gas furnace of FIG. 1 during operation in a modulating mode in a lower range to learn an operating curve for the modulating mode in the lower range.

Referring now to FIG. 8, a method 800 of controlling the furnace 10 in response to feedback from switches 64, 66, 68 during operation of the furnace 10 in modulating mode in the lower range to establish an operating curve for modulating mode in the lower range is shown. The method 800 may start at block 802, for example, in response to the furnace 10 being caused to operate in modulating mode in the lower range to establish an operating curve for modulating mode in the lower range.

Proceeding to block 804, the furnace 10 operates in modulating mode in the lower range to establish an operating curve for modulating mode in the lower range and proceeds to block 806.

At block 806, the method monitors the low pressure limit switch 64 and controls the furnace 10 according to blocks 508-526 of the method 500 of FIG. 5 but ignores the state of the high pressure limit switch 68. The method then proceeds to block 808.

At block 808, the method determines whether the intermediate pressure limit switch 66 is open. If the intermediate pressure limit switch 66 is not open, the method proceeds back to block 804. If the intermediate pressure limit switch 66 is open, the method proceeds to each of blocks 810 and 828.

At block 810, the method determines whether the communication necessary to monitor the intermediate pressure limit switch 66 is verified as operating correctly. If the communication is verified as operating correctly, the method proceeds to block 812. If the communication is not verified as operating correctly, the method proceeds to block 826 where the method attempts to reestablish communication and then proceeds back to block 810.

At block 812, the method waits 3 seconds and then proceeds to block 814.

At block 814, the method determines whether the intermediate pressure limit switch 66 remains open. If the intermediate pressure limit switch is not open, the method proceeds back to block 804. If the intermediate pressure limit switch is open, the method proceeds to block 816.

At block 816, the speed of the draft blower 26 is set to be increased by a predetermined speed increment. The method then proceeds to block 818.

At block 818, the method determines whether the increased speed exceeds the maximum draft blower 26 speed allowed for operation in the modulating mode in the lower range. If the increased speed does not exceed the maximum draft blower 26 speed allowed for the modulating mode in the lower range, the method proceeds to block 820. If the increased speed does exceed the maximum draft blower 26 speed allowed for the modulating mode in the lower range, the method proceeds to block 824.

At block 820, the method operates the draft blower 26 at the increased speed for 3 seconds. The method then proceeds to block 822.

At block 822, the method determines whether the intermediate pressure limit switch 66 is open. If the intermediate pressure limit switch 66 is not open, the method proceeds back to block 804. At the intermediate pressure limit switch 66 is open, the method proceeds back to block 816.

At block 824, the method operates the furnace 10 in the cycling mode for 10 minutes. In some embodiments, the method may thereafter attempt to relearn the operating curve for the modulating mode in the lower range.

At block 828, the method begins a 15 second timer. The method then proceeds to block 830.

At block 830, the method determines whether the intermediate pressure limit switch 66 has been closed before the 15 seconds of the timer of block 828 has elapsed. If the intermediate pressure limit switch 66 has been closed before the 15 seconds has elapsed, the method proceeds to block 832 were the timer is terminated. However, if the intermediate pressure limit switch 66 has not been closed before the 15 seconds has elapsed, the method proceeds to block 824. It will be appreciated that the actions of blocks 810-822, 826 occurs simultaneous with the duration of the operation of the 15 second timer functionality of blocks 828-832. Accordingly, if the actions of blocks 810-822, 826 do not close the intermediate pressure limit switch 66 within 15 seconds of the intermediate pressure limit switch 66 being open at block 808, the furnace 10 will be operated in the cycling mode prior to attempting to relearn the operating curves for the modulating mode in the lower range.

Figure 9:
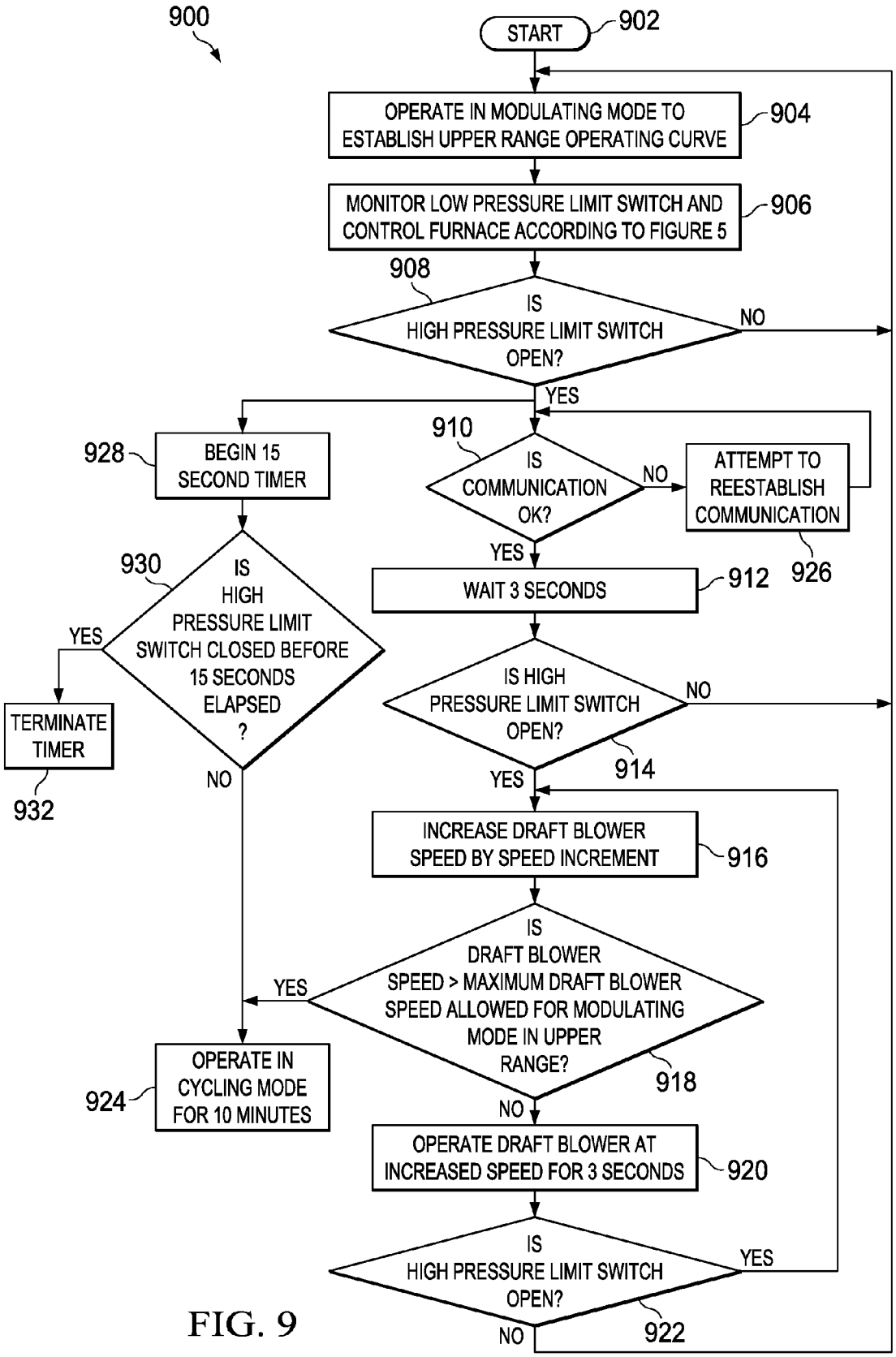
FIG. 9 comprises a flow chart that illustrates a method of operating the modulating gas furnace of FIG. 1 during operation in a modulating mode in an upper range to learn an operating curve for the modulating mode in the upper range.

Referring now to FIG. 9 a method 900 of controlling the furnace 10 in response to feedback from switches 64, 66, 68 during operation of the furnace 10 in modulating mode in the upper range to establish a an operating curve for the modulating mode in the upper range is shown. The method 900 may start at block 902, for example, in response to the furnace 10 being caused to operate in the modulating mode in the upper range to establish an operating curve for the modulating mode in the upper range.

Proceeding to block 904, the furnace 10 operates in the modulating mode in the upper range to establish an operating curve and proceeds to block 906.

At block 906, the method monitors the low pressure limit switch 64 and controls the furnace 10 according to blocks 508-526 of the method 500 of FIG. 5 The method then proceeds to block 908.

At block 908, the method determines whether the high pressure limit switch 68 is open. If the high pressure limit switch 68 is not open, the method proceeds back to block 904. If the high pressure limit switch 68 is open, the method proceeds to each of blocks 910 and 928.

At block 910, the method determines whether the communication necessary to monitor the high pressure limit switch 68 is verified as operating correctly. If the communication is verified as operating correctly, the method proceeds to block 912. If the communication is not verified as operating correctly, the method proceeds to block 926 where the method attempts to reestablish communication and then proceeds back to block 910.

At block 912, the method waits 3 seconds and then proceeds to block 914.

At block 914, the method determines whether the high pressure limit switch 68 remains open. If the high pressure limit switch 68 is not open, the method proceeds back to block 904. If the high pressure limit switch 68 is open, the method proceeds to block 916.

At block 916, the speed of the draft blower 26 is set to be increased by a predetermined speed increment. The method then proceeds to block 918.

At block 918, the method determines whether the increased speed exceeds the maximum draft blower 26 speed allowed for modulating mode in the upper range. If the increased speed does not exceed the maximum draft blower 26 speed allowed for modulating mode in the upper range, the method proceeds to block 920. If the increased speed does exceed the maximum draft blower 26 speed allowed for modulating mode in the upper range, the method proceeds to block 924.

At block 920, the method operates the draft blower 26 at the increased speed for 3 seconds. The method then proceeds to block 922.

At block 922, the method determines whether the high pressure limit switch 68 is open. If the high pressure limit switch 68 is not open, the method proceeds back to block 904. If the high pressure limit switch 68 is open, the method proceeds back to block 916.

At block 924, the method operates the furnace 10 in the cycling mode for 10 minutes. In some embodiments, the method may thereafter attempt to relearn the operating curve for the modulating mode in the upper range.

At block 928, the method begins a 15 second timer. The method then proceeds to block 930.

At block 930, the method determines whether the high pressure limit switch 68 has been closed before the 15 seconds of the timer of block 928 has elapsed. If the high pressure limit switch 68 has been closed before the 15 seconds has elapsed, the method proceeds to block 932 were the timer is terminated. However, if the high pressure limit switch 68 has not been closed before the 15 seconds has elapsed, the method proceeds to block 924. It will be appreciated that the actions of blocks 910-922, 926 occur simultaneous with the duration of the operation of the 15 second timer functionality of blocks 928-932. Accordingly, if the actions of blocks 910-922, 926 do not close the high pressure limit switch 68 within 15 seconds of the high pressure limit switch 68 being open at block 908, the furnace 10 will be operated in the cycling mode prior to attempting to relearn the operating curves for the modulating mode in the upper range.

In some embodiments, if the low pressure limit switch 64 remains closed during a learning routine even though the draft blower 26 is being operated below the minimum draft blower 26 speed for the cycling mode, furnace 10 operation may be halted until proper feedback is obtained from the switch 64. Similarly, if the intermediate pressure limit switch 66 remains closed during a learning routine even though the draft blower 26 is being operated below the minimum draft blower 26 speed for modulating mode in the lower range, the furnace 10 may require that LOW be relearned. Further, if the high pressure limit switch 68 remains closed during a learning routine even though the draft blower 26 is being operated below the minimum draft blower 26 speed for modulating mode in the upper range, the furnace 10 may require that LOW be relearned.

Figure 10:
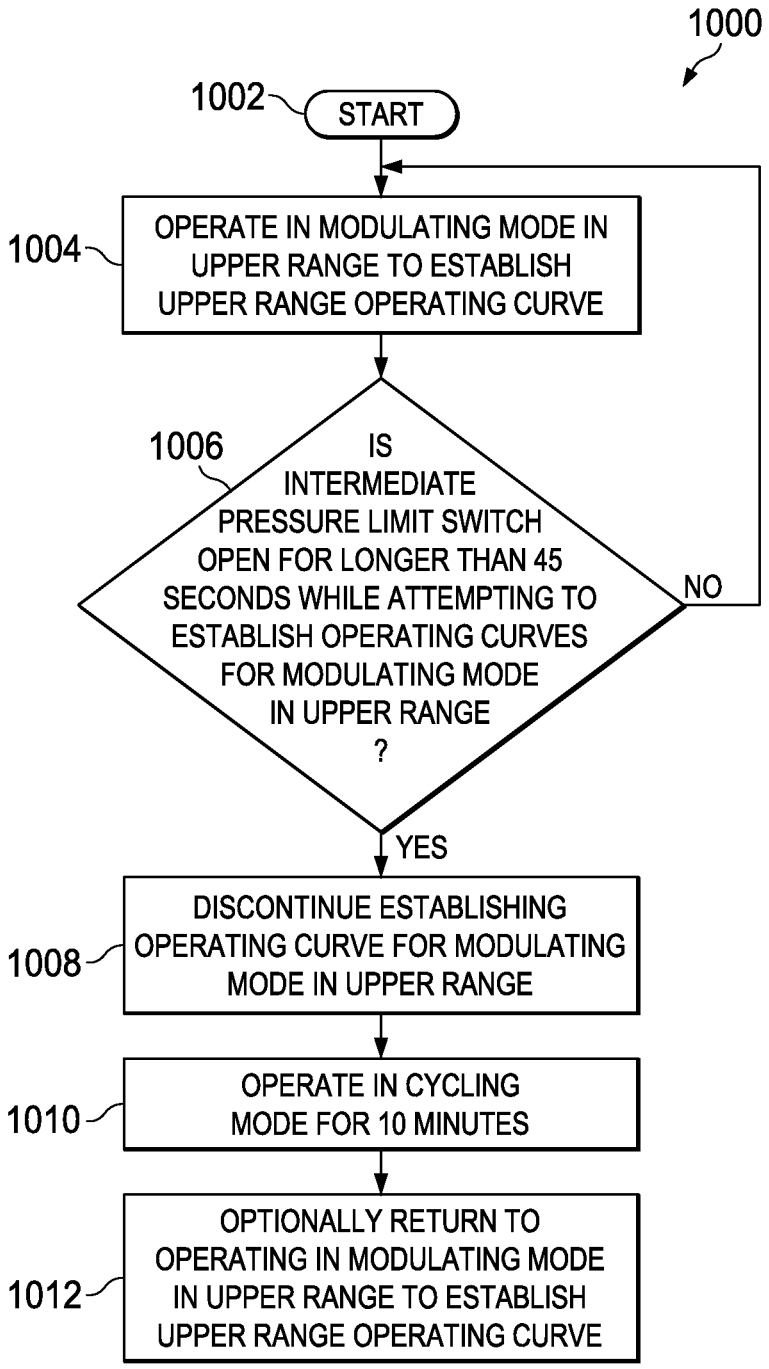
FIG. 10 comprises a flow chart that illustrates a method of monitoring an intermediate pressure switch while operating the modulating gas furnace according to the method of FIG. 9.

Referring now to FIG. 10, a method 1000 of monitoring the intermediate pressure limit switch 66 while operating the furnace 10 according to the method 900 is shown. Method 1000 may start at block 1002, like method 900, in response to the furnace 10 being caused to operate in the modulating mode in the upper range to establish an operating curve for the modulating mode in the upper range.

Proceeding to block 1004, the furnace 10 operates in the modulating mode in the upper range to establish an operating curve and proceeds to block 1006.

At block 1006, the method monitors the intermediate pressure limit switch 66 and determines whether the intermediate pressure limit switch 66 is open for longer than 45 seconds. If the intermediate pressure limit switch is not open for longer than 45 seconds, the method continues back to block 1004. If the intermediate pressure limit switch is open for longer than 45 seconds, the method continues to block 1008.

At block 1008, the operation according to method 900 is halted by discontinuing establishing an operating curve for the modulating mode in the upper range. The method continues to block 1010.

At block 1010, the furnace 10 is caused to operate in the cycling mode for 10 minutes. The method continues to block 1012.

At block 1012, the furnace may optionally return to operating in the modulating mode in the upper range to establish an operating curve for the modulating mode in the upper range.

It will be appreciated that furnace 10 may be operated according to one or more of the methods 400, 500, 600, 700, 800, and 900 to safely operate the furnace 10. It will further be appreciated that, in alternative embodiments, the output capacity percentages associated with each of LOW, INTERMEDIATE, and HIGH may be set at values other than 40%, 65%, and 100%. However in some embodiments, the output capacity associated with LOW, the pressure $P_L$, and the low pressure limit switch 64 (when configured to actuate at $P_L$) may be set as any other value below which may be undesirable to operate the modulating combustion system 14 because of a high risk of flame extinguishment. Similarly, the output capacity associated with HIGH, the pressure $P_H$, and high pressure limit switch 68 (when configured to actuate at $P_H$) may be set at any other output capacity above which value furnace 10 is not required to operate above or above which may be detrimental to the furnace 10. Further, the output capacity associated with INTERMEDIATE, the pressure $P_I$, and intermediate pressure limit switch 66 (when configured to actuate at $P_I$) may be set at any other value between the output capacities associated with LOW and HIGH.

Still further, it will be appreciated that the time limits (i.e., 0.5 seconds, 3 seconds, 15 seconds, 45 seconds, 1 minute, and 10 minutes) found in the methods 400, 500, 600, 700, 800, and 900 may, in alternative embodiments, be replaced by different time limits while still allowing for safe operation of the furnace 10.

Figure 11:
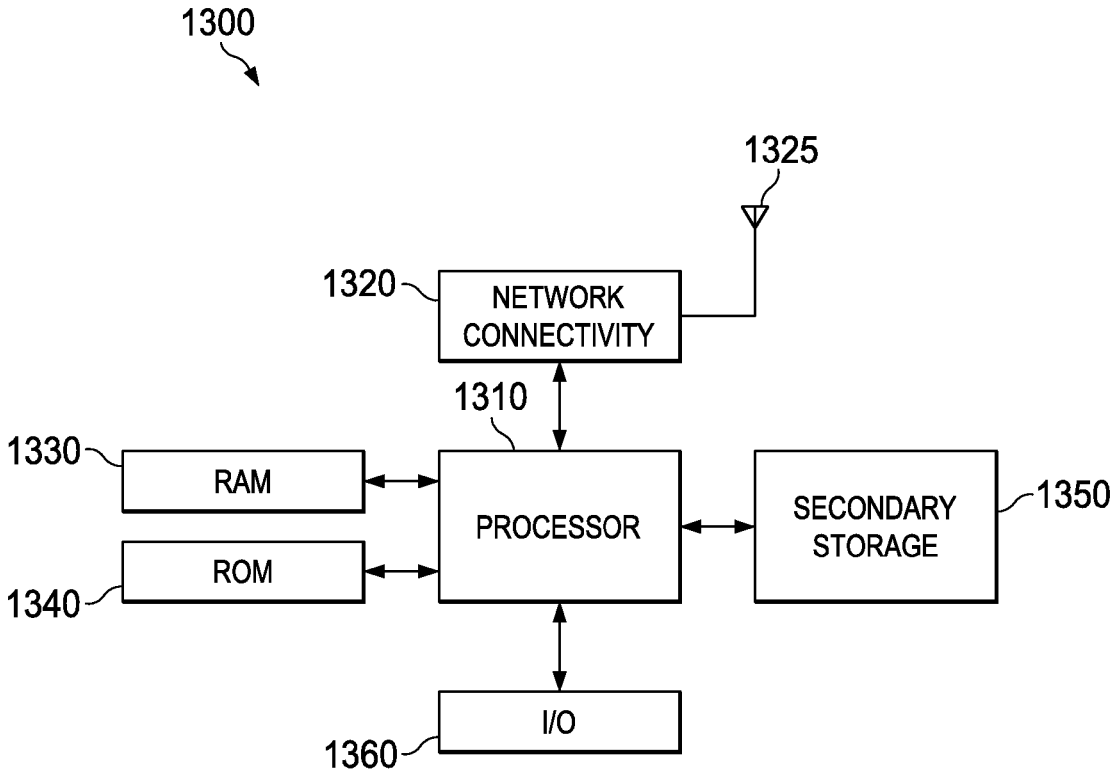
FIG. 11 illustrates a general-purpose processor (e.g., electronic controller or computer) system suitable for implementing the several embodiments of the present disclosure.

Referring now to FIG. 11, the furnace 10 or associated components may comprise a processing component (as a component of draft blower 26 and/or control assembly 20) that is capable of executing instructions related to the actions described previously. The processing component may be a component of a computer system. FIG. 11 illustrates a typical, general-purpose processor (e.g., electronic controller or computer) system 1300 that includes a processing component 1310 suitable for implementing one or more embodiments disclosed herein. In addition to the processor 1310 (which may be referred to as a central processor unit or CPU), the system 1300 might include network connectivity devices 1320, random access memory (RAM) 1330, read only memory (ROM) 1340, secondary storage 1350, and input/output (I/O) devices 1360. In some cases, some of these components may not be present or may be combined in various combinations with one another or with other components not shown. These components might be located in a single physical entity or in more than one physical entity. Any actions described herein as being taken by the processor 1310 might be taken by the processor 1310 alone or by the processor 1310 in conjunction with one or more components shown or not shown in the drawing.

The processor 1310 executes instructions, codes, computer programs, or scripts that it might access from the network connectivity devices 1320, RAM 1330, ROM 1340, or secondary storage 1350 (which might include various disk-based systems such as hard disk, floppy disk, optical disk, or other drive). While only one processor 1310 is shown, multiple processors may be present. Thus, while instructions may be discussed as being executed by a processor, the instructions may be executed simultaneously, serially, or otherwise by one or multiple processors. The processor 1310 may be implemented as one or more CPU chips.

The network connectivity devices 1320 may take the form of modems, modem banks, Ethernet devices, universal serial bus (USB) interface devices, serial interfaces, token ring devices, fiber distributed data interface (FDDI) devices, wireless local area network (WLAN) devices, radio transceiver devices such as code division multiple access (CDMA) devices, global system for mobile communications (GSM) radio transceiver devices, worldwide interoperability for microwave access (WiMAX) devices, and/or other well-known devices for connecting to networks. These network connectivity devices 1320 may enable the processor 1310 to communicate with the Internet or one or more telecommunications networks or other networks from which the processor 1310 might receive information or to which the processor 1310 might output information.

The network connectivity devices 1320 might also include one or more transceiver components 1325 capable of transmitting and/or receiving data wirelessly in the form of electromagnetic waves, such as radio frequency signals or microwave frequency signals. Alternatively, the data may propagate in or on the surface of electrical conductors, in coaxial cables, in waveguides, in optical media such as optical fiber, or in other media. The transceiver component 1325 might include separate receiving and transmitting units or a single transceiver. Information transmitted or received by the transceiver 1325 may include data that has been processed by the processor 1310 or instructions that are to be executed by processor 1310. Such information may be received from and outputted to a network in the form, for example, of a computer data baseband signal or signal embodied in a carrier wave. The data may be ordered according to different sequences as may be desirable for either processing or generating the data or transmitting or receiving the data. The baseband signal, the signal embedded in the carrier wave, or other types of signals currently used or hereafter developed may be referred to as the transmission medium and may be generated according to several methods well known to one skilled in the art.

The RAM 1330 might be used to store volatile data and perhaps to store instructions that are executed by the processor 1310. The ROM 1340 is a non-volatile memory device that typically has a smaller memory capacity than the memory capacity of the secondary storage 1350. ROM 1340 might be used to store instructions and perhaps data that are read during execution of the instructions. Access to both RAM 1330 and ROM 1340 is typically faster than to secondary storage 1350. The secondary storage 1350 is typically comprised of one or more disk drives or tape drives and might be used for non-volatile storage of data or as an over-flow data storage device if RAM 1330 is not large enough to hold all working data. Secondary storage 1350 may be used to store programs or instructions that are loaded into RAM 1330 when such programs are selected for execution or information is needed.

The I/O devices 1360 may include liquid crystal displays (LCDs), touch screen displays, keyboards, keypads, switches, dials, mice, track balls, voice recognizers, card readers, paper tape readers, printers, video monitors, transducers, sensors, or other well-known input or output devices (i.e., a thermostat). Also, the transceiver 1325 might be considered to be a component of the I/O devices 1360 instead of or in addition to being a component of the network connectivity devices 1320. Some or all of the I/O devices 1360 may be substantially similar to various components depicted in the previously described FIGS. 1 and 2.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A modulating gas furnace, comprising:

a modulating combustion system, comprising:

a burner assembly;

a modulating gas valve assembly configured to modulate an amount of fuel gas delivered to the burner assembly as a result of a measured pressure differential; and at least one of (1) a pressure sensor configured to measure the pressure differential and (2) a low pressure limit switch, an intermediate pressure limit switch, and a high pressure limit switch, wherein each of the low pressure limit switch, the intermediate pressure limit switch, and the high pressure limit switch are configured to actuate at different pressure differential values;

wherein the measured pressure differential is measured between an upstream pressure tap disposed in a combustion space and a downstream pressure tap disposed within a header; and wherein the modulating combustion system is configured to selectively maintain steady state operation at a plurality of firing rates within at least one of a cycling mode, a modulating mode in a lower range, and a modulating mode in an upper range.

2. The modulating gas furnace of claim 1, wherein the low pressure limit switch is configured to actuate at a first pressure value; wherein the intermediate pressure limit switch is configured to actuate at a second pressure value; wherein the high pressure limit switch is configured to actuate at a third pressure value; and wherein the second pressure value is between the first pressure value and the third pressure value.

3. The modulating gas furnace of claim 2, wherein when the modulating gas furnace is operated in the cycling mode, the modulating gas furnace is operated in response to the low pressure limit switch but not in response to the intermediate pressure limit switch and not in response to the high pressure limit switch.

4. The modulating gas furnace of claim 2, wherein when the modulating gas furnace is operated in the modulating mode in the lower range, the modulating gas furnace is operated in response to the low pressure limit switch and the intermediate pressure limit switch but not in response to the high pressure limit switch.

5. The modulating gas furnace of claim 2, wherein while the modulating gas furnace is operated in the modulating mode in the upper range, the modulating gas furnace is operated in response to the low pressure limit switch and the high pressure limit switch but not in response to the intermediate pressure limit switch.

6. The modulating gas furnace of claim 2, wherein the modulating gas furnace is not ignited when any one of the low pressure limit switch, intermediate pressure limit switch, and high pressure limit switch is open.

7. The modulating gas furnace of claim 2, further comprising:

a draft blower, wherein when the modulating gas furnace is operated in the cycling mode and the low pressure limit switch is not closed, a draft blower speed is increased.

8. The modulating gas furnace of claim 7, wherein when the draft blower speed is increased above a maximum draft blower speed for the cycling mode, a furnace cycle is interrupted.

9. The modulating gas furnace of claim 2, further comprising:

a draft blower, wherein when the modulating gas furnace is operated to establish an operating curve in the modulating mode in the lower range and at least one of the low pressure limit switch and the intermediate pressure limit switch is not closed, a draft blower speed is increased.

10. The modulating gas furnace of claim 9, wherein when the draft blower speed is increased above a maximum draft blower speed for the modulating mode in the lower range, a furnace cycle is interrupted.

11. The modulating gas furnace of claim 2, further comprising:

a draft blower, wherein when the modulating gas furnace is operated to establish an operating curve in the modulating mode in the upper range and at least one of the low pressure limit switch, the intermediate pressure limit switch, and the high pressure limit switch is not closed, a draft blower speed is increased.

12. The modulating gas furnace of claim 11, wherein when the draft blower speed is increased above a maximum draft blower speed for the modulating mode in the upper range, a furnace cycle is interrupted.

13. A modulating gas furnace, comprising:

a low pressure limit switch configured to actuate at a first pressure;

an intermediate pressure limit switch configured to actuate at a second pressure; and a high pressure limit switch configured to actuate at a third pressure, wherein the second pressure is between the first pressure and the third pressure;

wherein the modulating gas furnace is configured to operate in one of a cycling mode, a modulating mode in a lower range, and a modulating mode in an upper range in response to at least one of the low pressure limit switch, the intermediate pressure limit switch, and the high pressure limit switch;

wherein the modulating mode in the lower range is associated with an output capacity range between the output capacity ranges of the cycling mode and the modulating mode in the upper range; and wherein the modulating gas furnace is configured to selectively maintain steady state operation at a plurality of firing rates within at least one of the modulating mode in the lower range and the modulating mode in the upper range.

14. The modulating gas furnace of claim 13, further comprising:

a modulating gas valve assembly configured to modulate an amount of fuel gas delivered to a burner assembly of the modulating gas furnace in response to actuation of at least one of the low pressure limit switch, the intermediate pressure limit switch, and the high pressure limit switch.

15. The modulating gas furnace of claim 13, wherein when the modulating gas furnace is operated in the cycling mode, the modulating gas furnace is operated in response to the low pressure limit switch but not in response to the intermediate pressure limit switch and not in response to the high pressure limit switch.

16. The modulating gas furnace of claim 13, wherein when the modulating gas furnace is operated in the modulating mode in the lower range, the modulating gas furnace is operated in response to the low pressure limit switch and in response to the intermediate pressure limit switch, but not in response to the high pressure limit switch.

17. The modulating gas furnace of claim 13, wherein when the modulating gas furnace is operated in the modulating mode in the upper range, the modulating gas furnace is operated in response to each of the low pressure limit switch, the intermediate pressure limit switch, and the high pressure limit switch.

18. The modulating gas furnace of claim 13, wherein the modulating gas furnace is configured to at least one of (1) operate in the modulating mode in the lower range to establish an operating curve for the modulating mode in the lower range and (2) operate in the modulating mode in the upper range to establish an operating curve for the modulating mode in the upper range.

* * * * *